United States Patent [19]

Smith

[11] Patent Number: 4,826,229

[45] **Date of Patent: * May 2, 1989**

[54] CABLE RELEASE MECHANISM

[76] Inventor: Gregory L. Smith, 702 Comanche Trail, West Monroe, La. 71291

[ * ] Notice: The portion of the term of this patent subsequent to Sep. 10, 2002 has been disclaimed.

[21] Appl. No.: 33,826

[22] Filed: Apr. 3, 1987

[51] Int. Cl.[4] ..... B63B 21/60; B66C 1/34

[52] U.S. Cl. ..... 294/82.27; 294/82.3; 294/82.34; 114/252

[58] Field of Search ..... 294/82.27, 82.33, 82.24, 294/82.26, 82.3, 82.31, 82.32, 82.34, 88, 75, 103.1, 104, 66.1, 82.28, 905; 24/232, 233, 234, 235, 241 P, 241 PP, 241 R; 114/230, 252, 238

[56] References Cited

U.S. PATENT DOCUMENTS 4,540,210 9/1985 Smith ..... 294/82.27

4,555,133 11/1985 Danielsen et al. ..... 294/82.33

*Primary Examiner*—James B. Marbert

*Attorney, Agent, or Firm*—John M. Harrison

[57] ABSTRACT

An improved portable cable release mechanism for mounting on the deck of a tow boat, tug, ship or dock and used to tow and dock barges, boats and ships, which mechanism is designed to receive one end of a tow cable or docking cable in order to secure and selectively release the vessels. The cable release mechanism includes a pelican hook pivotally attached to a frame which can be removably mounted on a dock or secured to the deck of a tow boat, ship or barge by means of a clevis plate. A sliding keeper normally secures the pelican hook in closed configuration in the frame and release of a towing or docking cable from the pelican hook is automatically effected by activating an air or hydraulic cylinder having a piston provided in cooperation with the keeper ring. This action extends the cylinder piston and forces the keeper from engagement with the pelican hook, allowing the pelican hook to pivot rearwardly responsive to the load on the cable. Alternatively, a lanyard cable is provided for manual release of the pelican hook.

22 Claims, 1 Drawing Sheet

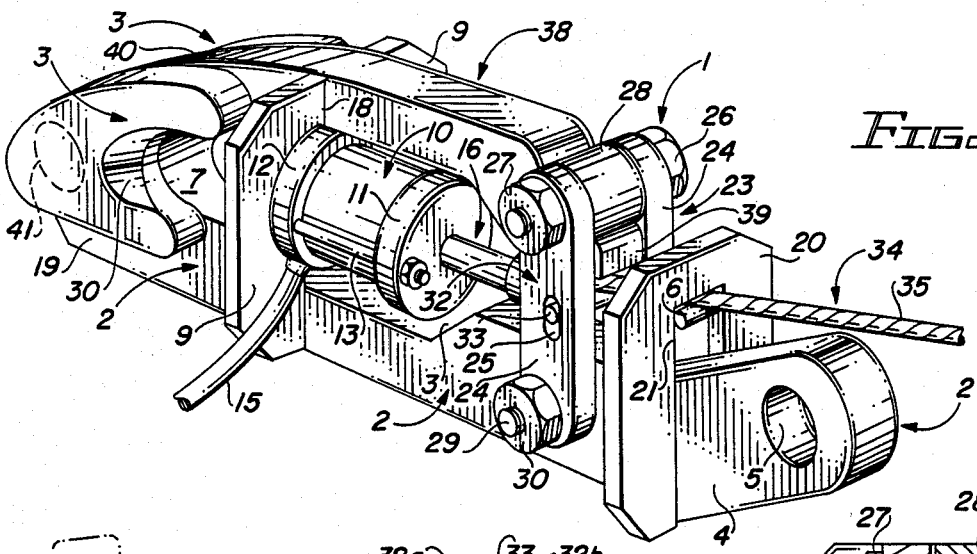
FIG. 1
FIG. 5
FIG. 3
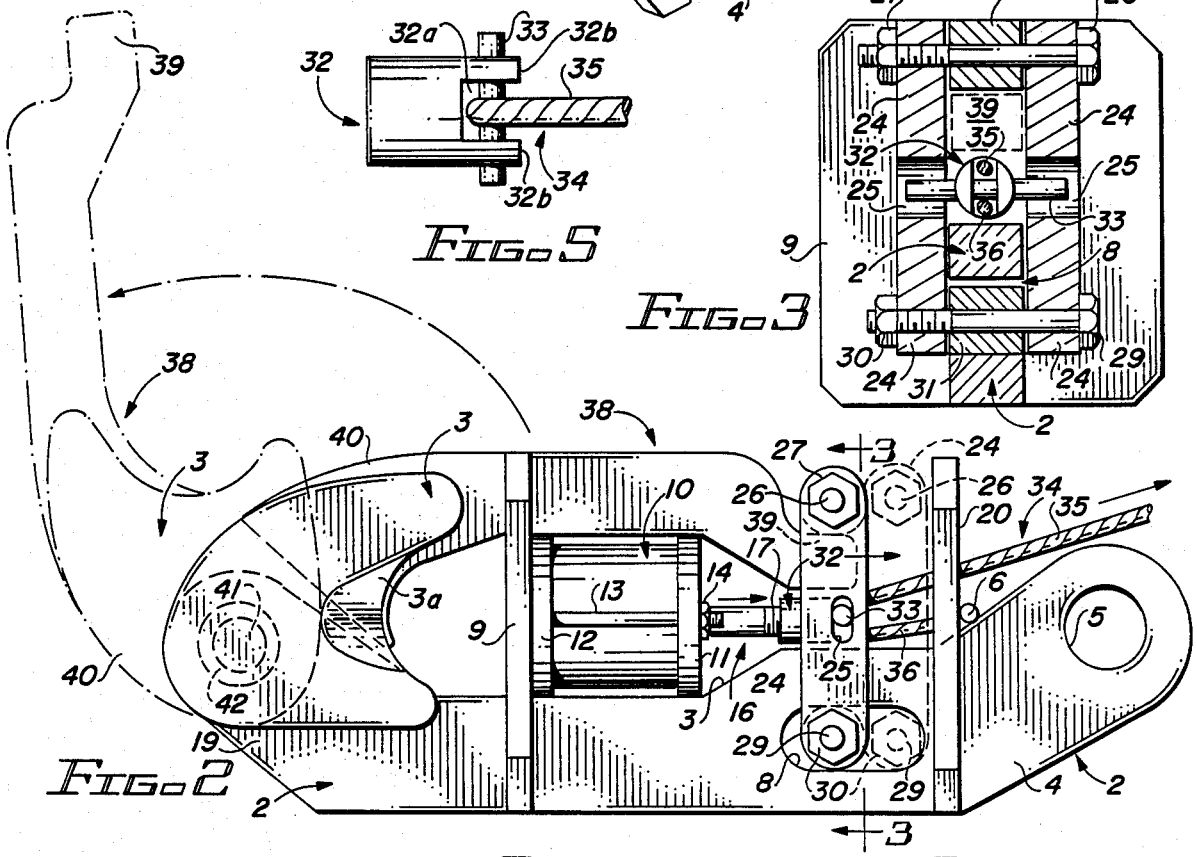
FIG. 2
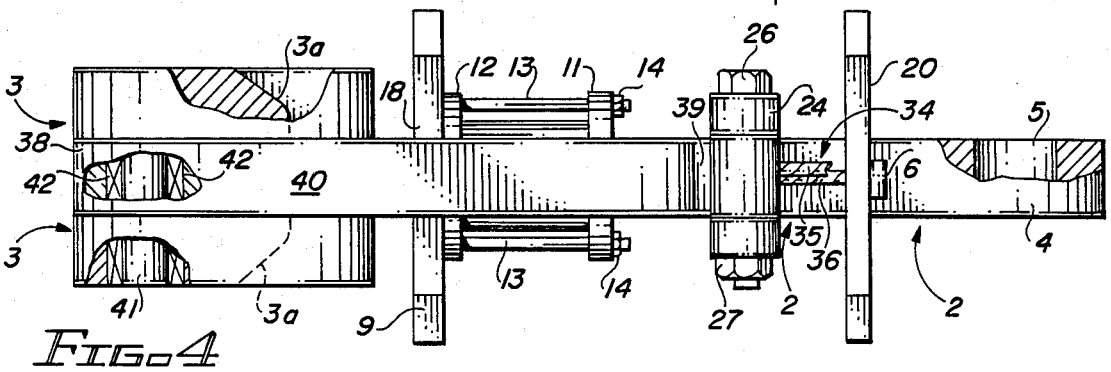
FIG. 4

CABLE RELEASE MECHANISM

BACKGROUND OF THE INVENTION

1. Field of the Invention

This invention relates to release mechanisms for securing and quickly releasing tow boats and tugs from one or a string of barges, as well as boats and ships from docks. More particularly, the invention relates to a remote controlled, air or hydraulically operated, portable cable release mechanism which improves the conventional pelican hook release devices currently in use and is sufficiently versatile to be used not only on tow boats but also on docks and ships as well. In a typical river barge towing arrangement according to this invention, the tow boat is connected to a string of barges by means of steel tow cables which may be as large as 1¼ inches or fiber rope cables as large as 3 inches in diameter. The tow cables are typically looped through a pelican hook and keeper ring device mounted on or secured to the deck of the tow boat and then around the tow boat and barge deck fittings, to one or more winches for adjusting the distance between the lead barge or barges and the tow boat. The end of each towing cable which is attached to a pelican hook is typically provided with a loop which fits around the neck of the pelican hook near the point of pivot of the pelican hook in the base. The free end of the pelican hook is then pivoted downwardly and forwardly while the cable is slack, to facilitate manipulation of a keeper ring, which is slidably attached to the base, over the end of the pelican hook. The keeper ring thus deployed prevents the pelican hook from pivoting rearwardly on its hinges and releasing each cable loop when tension is placed on the cables by the winch. The barges are then manipulated into alignment with the tow boat and are maintained in this orientation while the barges are being towed. Accordingly, in the event of an emergency which requires release of the barges from the tow boat, the keeper ring can be removed by remote control from the end of the pelican hook, or it can be manually removed by means of a sledge hammer, pry bar or screwdriver during the towing operation.

Conventional docking techniques using cables and ropes depend upon careful orchestration of all lines by deckhands and dock crews to prevent damage to the dock and/or the ship or vessel. The cable release mechanism of this invention can be mounted on a dock or ship to secure the ship to a dock and release the ship from the dock in a uniform and efficient manner.

2. Description of the Prior Art

A cable release mechanism for mounting on a tow boat and securing a string of barges in towing configuration is disclosed in my U.S. Pat. No. 4,540,210, dated Sept. 10, 1985. Conventional pelican hook cable retaining mechanisms have long been used on tow boats to releasably secure towing cables to barges and are generally characterized by an elongated pelican hook which is pivotally attached to a pair of hinges welded to a base plate or to the deck of a tow boat. The base plate is in turn bolted or otherwise secured to the deck of the tow boat and a keeper ring is loosely mounted on a keeper ring stay, which is also welded or otherwise attached to the base or tow boat deck adjacent the free end of the pelican hook. Accordingly, the keeper ring is slipped over the end of the pelican hook when the pelican hook is rotated downwardly on the hinges to secure the cable loop of a towing cable between the pelican hook and the base plate or tow boat deck. The keeper ring can be quickly removed from the end of the pelican hook during the towing operation by sharply striking it or prying it to release the cable loop and cable. A disadvantage of manually releasing the keeper ring from the end of the pelican hook in this manner is found in the large amount of stress which is placed on the pelican hook and the keeper ring during towing of a barge or barges. The rearward force on the pelican hook assembly due to the weight of the barge or barges and the force of the tow boat pulling the barge string causes the pelican hook to press tightly against the keeper ring. Accordingly, considerable force is often required to dislodge the keeper ring from the end of the pelican hook. Accomplishing this act with the aid of a sledge hammer or pry bar has resulted in injury to the operator, since the force of the pelican hook rapidly pivoting upwardly and rearwardly after the keeper ring is dislodged under towing conditions has, on occasion, knocked the sledge hammer or pry bar completely out of the hands of the operator. Another disadvantage of the conventional pelican hook is the typically narrow deck or cable-bearing area, which frequently causes flattening and sometimes failure of the cable due to the large stresses applied to the cable.

As noted above, a cable release mechanism for mounting on the deck of a tow boat, tug or other vessel for towing barges is disclosed in my U.S. Pat. No. 4,540,210 dated Sept. 10, 1985. Other patents pertinent to the subject matter of this patent are noted as patent references of record in that patent.

Yet another problem associated with prior art remote control release mechanisms is the complexity of such devices, a factor which sometimes results in malfunction of the devices due to the relative large number of parts which must interact in a certain way to achieve the desired result. Furthermore, as heretofore described, conventional manually operated pelican hook and keeper ring cable stay devices are dangerous to trip and require an operator to be in a hazardous position in an emergency. Accordingly, it is an object of this invention to provide a new and improved portable pelican hook cable release mechanism which is simple in design, easy to operate from a safe and remote location on the boat, ship or dock. The cable release mechanism includes an improved pivoting pelican hook and positive keeper assembly provided in cooperation with a fluid activated cylinder, to selectively engage and secure a tow cable during barge towing operations and a ship or boat during docking operations and to quickly, easily and remotely or manually release the tow cable or dock cable from the cable release mechanism in the event of an emergency or during normal operation.

Another object of this invention is to provide a new and improved, portable remote control or manual cable release mechanism of the pelican hook and keeper design for securing and selective releasing a tow cable from a tow boat and docking cables from ships and other vessels. The cable release mechanism includes a pelican hook assembly fitted with a hydraulic or air cylinder and a sliding keeper attached to the cylinder piston, which keeper is provided in normally engaged position on the end of the pelican hook during the towing or docking operation and is operationally displaced from the end of the pelican hook in remote control mode by activation of the air or hydraulic cylinder. Extension of the cylinder piston in manual mode is effected by manipulation of a lanyard cable to remove the keeper from contact with the pelican hook.

A still further object of the invention is to provide an improved remote control or manually operated, portable pelican hook and keeper cable release mechanism which can be removably mounted to the deck of a tow boat and utilized in cooperation with a standard winch system on the tow boat to releasably secure one end of a tow cable and bind a barge string to the tow boat. The cable release mechanism is characterized by a pelican hook pivotally mounted on a hinge or hinges attached to a frame and a cooperating keeper attached to the piston of a hydraulic or air cylinder also mounted on the frame, which cylinder can be activated to extend the cylinder piston with respect to the frame and remove the keeper from contact with the pelican hook in automatic operation. The keeper can be manually slidably adjusted from the end of the pelican hook by operation of a lanyard cable in an emergency situation to release the tow cable from the pelican hook and the tow boat.

Yet another object of this invention is to provide an improved automatic or manual cable release mechanism incorporating a pelican hook and a keeper assembly, which mechanism can be removably mounted on the deck of a tow boat or on a dock for securing the looped end of a tow cable or dock cable to the pelican hook and removably securing the pelican hook in folded, closed position by means of a keeper which is mounted on the end of a piston carried by an air or hydraulic cylinder. The air or hydraulic cylinder is provided with a solenoid valve and appropriate remote controls, in order to facilitate remote activation of the air or hydraulic cylinder and extension of the cylinder piston in remote control operation. Manual extension of the keeper from the pelican hook can also be facilitated by operation of a lanyard cable, to release the cable under towing or docking conditions.

SUMMARY OF THE INVENTION

These and other objects of the invention are provided in a new and improved, selectively remote or manually operated, portable pelican hook and keeper release mechanism for placement on the deck of a tow boat or dock and releasably securing a tow cable to the tow boat and one or more barges under tow, or a docking cable linking the release mechanism to a ship or vessel being held in docked position. The mechanism includes a pelican hook pivotally mounted on a hinged base and an air or hydraulic cylinder also mounted on the base and provided with a piston which engages a keeper. The keeper is slidably attached to the base and engages the free end of the pelican hook when the piston is retracted, to secure the pelican hook in towing or retaining configuration when tension is placed on the towing cable or the docking cable. The air or hydraulic cylinder can be remotely activated by utilizing solenoid, air or hydraulic valves or other known valving techniques and accessory fluid pressure equipment, as detailed in my U.S. Pat. No. 4,540,210, to automatically extend the piston, disengage the keeper from the end of the pelican hook and release the towing or docking cable in the event of an emergency or when it is desired to release a docked ship. The cable release mechanism can also be manually operated by applying tension to a lanyard cable which is looped around a pin attached to the keeper, in order to slidably displace the keeper from contact with the end of the pelican hook.

BRIEF DESCRIPTION OF THE DRAWING

The invention will be better understood by reference to the accompanying drawing, wherein:

FIG. 1 is a perspective view of the cable release mechanism of this invention, illustrated in functional configuration;

FIG. 2 is a side elevation of the cable release mechanism illustrated in FIG. 1, with the pelican hook shown in release configuration in phantom;

FIG. 3 is a sectional view taken along line 3—3 of the cable release mechanism illustrated in FIG. 2;

FIG. 4 is a top elevation of the cable release mechanism illustrated in FIG. 1; and FIG. 5 is a detail of a preferred rod clevis for mounting on the end of the piston and coupling to the keeper of the cable release mechanism of this invention.

DESCRIPTION OF THE PREFERRED EMBODIMENTS

Referring initially to FIGS. 1 and 2 of the drawing, in a preferred embodiment the cable release mechanism of this invention is generally illustrated by reference numeral 1. The cable release mechanism 1 is characterized by an elongated frame 2, having a pin base 19 at the rear end thereof and provided with an upward-standing clevis plate 4 at the front end thereof. A clevis opening 5 is provided in the clevis plate 4, in order to anchor the cable release mechanism 1 to a secure object such as a deck fitting, timber head or other deck rigging on a tow boat or on the dock for docking purposes, as hereinafter further described. A cable plate 20 is welded to the clevis plate 4 and is provided with a narrow cable mount slot 21, which is sufficiently wide to accommodate a lanyard cable 34, as illustrated in FIG. 1. A clamp lead eye 6 is secured to the end of the bottom segment 36 of the lanyard cable 34 and spans the cable mount slot 21, for mounting the bottom segment 36 of the lanyard cable 34, in order to manually operate the cable release mechanism 1, as also hereinafter further described. The ends of a pelican hook pin 41, extending through a bearing 42, which is seated in the pin base 19 of the frame 2, are welded or otherwise secured to the side plates 3, in order to pivotally support the pelican hook 38 on the pin base 19 of the frame 2. Accordingly, referring to FIG. 2, the pelican hook 38 and side plates 3 are able to swing upwardly as illustrated in phantom when in the release configuration, as hereinafter further described.

Referring now to FIGS. 1–4 of the drawing, a frame slot 8 is provided in the lower portion of the frame 2 at a point rearwardly of the clevis plate 4, in order to receive a bottom bolt 29 and a bottom shim 31, which is rotatably mounted on the bottom bolt 29 and forms a lower element of the keeper 23. The bottom bolt 29 and cooperating bottom nut 30 serve to maintain the bottom ends of a pair of keeper bars 24 in parallel alignment with the upper end of the keeper bars 24, which are further secured in parallel orientation by a top bolt 26 and a cooperating top nut 27, as illustrated. A top shim 28 is rotatably mounted on the top bolt 26 between the keeper bars 24 and the keeper bars 24 are each further characterized by a bar slot 25, as illustrated in FIGS. 1–3. A cylinder mount plate 9, provided with a mount plate slot 18 for seating the pelican hook 38, is welded or otherwise securely attached in vertical orientation to the frame 2 at a point immediately forward of the pin base 19. The cylinder mount plate 9 serves to support an air or hydraulic cylinder 10 by means of cylinder mount bolts 13 and cooperating cylinder mount nuts 14. The cylinder 10 is fitted with a rear cylinder cap 12, which seats against the cylinder mount plate 9 and a front cylinder cap 11, which extends from the front portion of the cylinder 10. A fluid line 15 extends from the rear cylinder cap 12, in order to supply air or hydraulic fluid to the cylinder 10, as desired. A piston 16 extends from the front cylinder cap 11 of the cylinder 10 and a rod clevis 32 is threadibly attached to the piston thread 17 shaped in the end of the piston 16. As further illustrated in FIGS. 3 and 5 of the drawings, the rod clevis 32 is provided with a clevis slot 32*a* at the forward end thereof, which defines a pair of parallel clevis arms 32*b*, that receive a lanyard pin 33, which extends through the clevis arms 32*b* and the bar slots 25, located in each of the keeper bars 24. Accordingly, the piston 16 is secured to the keeper 23 by means of the rod clevis 32 and the lanyard pin 33 and the lanyard cable 34 is looped around the lanyard pin 33, such that the top cable segment 35 of the lanyard cable 34 extends above the clevis plate 4, while the bottom cable segment 36 of the lanyard cable 34 is anchored by the clamp lead eye 6, as the bottom cable segment 36 extends through the cable plate slot 21, as illustrated in FIGS. 1, 2 and 4 of the drawing. The cable plate 20 is preferably welded or otherwise attached in vertical orientation to the frame 2 in spaced, generally parallel relationship with respect to the cylinder mount plate 9 and the narrow cable plate slot 21 slidably receives the top cable segment 35 of the lanyard cable 34.

Referring again to FIGS. 1, 2, and 4 of the drawings, in a most preferred embodiment of the invention the pelican hook 38 is fitted with a forwardly extending pelican hook seat 39, which normally extends beneath the top shim 28 of the keeper 23 when the cable release mechanism 1 is in closed, cable retention configuration. Accordingly, when a tow cable or docking cable (not illustrated) is secured to the cable release mechanism 1 by attaching a loop of the cable in the plate chamfer 3*a* of the side plates 3, the cable is maintained in towing or docking configuration by the pelican hook 38. It will be appreciated by those skilled in the art that an appropriate valve and control mechanism such as the mechanism described in my U.S. Pat. No. 4,540,210, can be provided for automatically operating the cable release mechanism 1, according to the knowledge of those skilled in the art. For example, if the cylinder 10 is characterized by a hydraulic cylinder, then hydraulic fluid can be pumped through the fluid line 15 at the appropriate time to release a tow or docking cable from the cable release mechanism, as hereinafter described. Alternatively, if the cylinder 10 is designed to operate on air, then air can be forced through the fluid line 15 at an appropriate operating pressure, in order to activate the cylinder 10 and secure release of a cable from the cable release mechanism 1.

In operation, when it is desired to release a tow or docking cable (not illustrated) from a position lodged against the plate chamfer 3*a* in the side plates 3, a working fluid such as hydraulic fluid or air, depending upon the design of the cylinder 10, is injected through the fluid line 15 by an appropriate control device {not illustrated}. This action causes the piston 16 to extend against the bias of an internal spring (not illustrated) located inside the cylinder 10 in the direction of the arrow as illustrated in FIG. 2, and forces the keeper 23 forwardly, with the bottom bolt 29 and the bottom shim 31 riding in the frame slot 8 and the top shim 28 traversing the bottom edge of the pelican hook seat 39 of the pelican hook 38. When the keeper 23 has moved forwardly a sufficient distance to facilitate clearance of the top shim 28 from the pelican hook seat 39, the tension in the tow or docking cable causes the pelican hook 38 to pivot rearwardly and release the cable from the plate chamfer 3*a*. When it is desired to again place a cable in position against the plate chamfer 3*a*, the pelican hook 38 is first pivoted rearwardly to the position illustrated in phantom in FIG. 2. When the cable is located in the appropriate position, the pelican hook is again pivoted downwardly to the position illustrated in FIGS. 1–4 as the cylinder 10 is operated, to engage the top shim 28 with the pelican hook seat 39 of the pelican hook 38 and secure the cable in towing or docking position. If the cylinder 10 or the control system therefor fails to operate as anticipated, then the pelican hook 38 can be manually released by grasping a lanyard handle (not illustrated) which may be connected to the extending end of the top cable segment 35 of the lanyard cable 34 and applying tension to the lanyard cable 34. This action manually forces the keeper 23 forwardly against the bias of the spring (not illustrated) located in the cylinder 10, as illustrated by the arrow in FIG. 2, to release the pelican hook 38, as further illustrated in phantom in FIG. 2. It will be appreciated that tension applied to the top cable segment 35 of the lanyard cable 34 causes the lanyard cable 34 to slide on the lanyard pin 33, since the opposite end of the lanyard cable 34 is secured by the clamp lead eye 6, to force the keeper 23 forwardly and release the keeper 23 from the pelican hook seat 39.

It will be appreciated by those skilled in the art that the portable nature of the cable release mechanism 1 of this invention facilitates use of the device in a wide variety of applications. For example, as heretofor noted, the cable release mechanism 1 can be permanently or removably mounted to the deck of a tow boat, as taught in my U.S. Pat. No. 4,450,210, and used to secure one or more barges in quick-release configuration. Furthermore, the cable release mechanism 1 can be attached by means of a clevis and chain or cable to a dock fitting or timber head on a dock, or on a ship or boat, in order to facilitate docking and releasing of large ships and boats such that the ships and boats can be quickly and easily docked and released without damage to the docking cables or to the vessel being docked or released.

Referring again to FIG. 1 of the drawings, in another most preferred embodiment of the invention the plate chamfer 3*a* is about four to five inches in length and about three inches wide, in order to fully support a steel tow or docking cable having a diameter up to about $1\frac{1}{4}$ inches or a fiber rope cable having a diameter of up to about three inches. This wide bearing surface helps to prevent excessive flattening of the cable loop and serves to extend the life of the cable itself during the towing, docking or releasing operation. Furthermore, the plate chamfer 3*a* is designed to accommodate both wire cables and hemp ropes, as well as other towing lines or rigging which may be used in the trade.

In yet another most preferred embodiment of the invention, it has been found that an optimum location for the plate chamfer 3*a* is slightly above the centerline of the horizontal axis of the pelican hook pin 41. This orientation of the plate chamfer 3*a* facilitates positioning of a tow or docking cable loop on the plate chamfer 3*a* with the rearward force vector in the tow cable or dock cable loop located slightly above the horizontal axis of the pelican hook pin 41, in order to insure immediate opening of the pelican hook 41 upon disengagement of the keeper 23. Since the disengagement of the pelican hook 38 from the keeper 23 sometimes results in vibration and stress in the frame 2, the bar slot 25 is provided in the keeper bars 24, to allow the lanyard pin 33 to move vertically with respect to the keeper 23 and minimize stress on the cylinder 10.

Referring again to FIG. 1 of the drawing, while the lanyard cable 34 is preferably looped around the lanyard pin 33, the lanyard cable 34 can be connected directly to the lanyard pin 33, or directly to the keeper 23, to force the keeper 23 forwardly.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a cable release mechanism having a frame, a pelican hook pivotally mounted on the frame and a keeper ring provided in slidable cooperation with the frame and normally engaging the free end of the pelican hook to retain a towing cable against the pelican hook, the improvement in combination therewith comprising a fluid-operated cylinder carried by said frame; a piston cooperating with said cylinder in reciprocating relationship, said piston having one end extending from said cylinder, said one end of said piston engaging said keeper ring for selective disengagement of the keeper ring from the free end of the pelican hook responsive to fluid activation of said cylinder and release of the cable from the pelican hook; a lanyard pin vertically carried by said keeper ring in slidable relationship; and a lanyard cable having one end removably attached to said frame, said lanyard cable engaging said lanyard pin for manually slidably displacing said keeper ring from said free end of said pelican hook and releasing the towing cable responsive to tensioning of said lanyard cable.

2. The cable release mechanism of claim 1 further comprising a pair of side plates carried by said pelican hook and a plate chamfer provided in each of said side plates, for receiving and seating the towing cable against said pelican hook.

3. The cable release mechanism of claim 2 wherein the center of said plate chamfer is located in a horizontal plane above the axis of pivot of the pelican hook.

4. The cable release mechanism of claim 1 further comprising clevis means having one end secured to said lanyard pin and the opposite end attached to said piston, for connecting said keeper ring to said piston.

5. The cable release mechanism of claim 1 further comprising:

(a) a pair of side plates carried by said pelican hook and a plate chamfer provided in each of said side plates, for receiving and seating the towing cable against said pelican hook; and (b) clevis means having one end secured to said lanyard pin and the opposite end attached to said piston for connecting said keeper ring to said piston.

6. The cable release mechanism of claim 5 wherein the center of said plate chamfer is located in a horizontal plane above the axis of pivot of the pelican hook.

7. The cable release mechanism of claim 1 further comprising a vertical slot provided in said keeper ring and wherein said lanyard pin is slidably disposed in said vertical slot.

8. The cable release mechanism of claim 1 further comprising a clevis plate carried by the frame and a clevis opening provided in said clevis plate for mounting said clevis plate and said cable release mechanism to a secure structure.

9. The cable release mechanism of claim 1 further comprising:

(a) a pair of side plates carried by said pelican hook and a plate chamfer provided in each of said side plates, for receiving and seating the towing cable against said pelican hook;

(b) clevis means having one end secured to said lanyard pin and the opposite end attached to said piston for connecting said keeper ring to said piston; and (c) a vertical slot provided in said keeper ring and wherein said lanyard pin is slidably disposed in said vertical slot.

10. The cable release mechanism of claim 9 wherein the center of said plate chamfer is located in a horizontal plane above the axis of pivot of the pelican hook.

11. The cable release mechanism of claim 10 further comprising a clevis plate carried by the frame and a clevis opening provided in said clevis plate for mounting said clevis plate and said cable release mechanism to a secure structure.

12. The cable release mechanism of claim 1 further comprising a horizontal slot provided in the frame and wherein the keeper ring is further characterized by a pair of keeper plates, a top shim and a bottom shim rotatably carried by said keeper plates, said top shim normally provided in engagement with the free end of said pelican hook and said bottom shim provided in registration with said horizontal slot in said frame when said cable release mechanism is in functional configuration.

13. The cable release mechanism of claim 12 further comprising:

(a) a pair of side plates carried by said pelican hook and a plate chamfer provided in each of said side plates, for receiving and seating the towing cable against said pelican hook;

(b) clevis means having one end secured to said lanyard pin and the opposite end attached to said piston for connecting said keeper ring to said piston; and (c) a vertical slot provided in said keeper ring and wherein said lanyard pin is slidably disposed in said vertical slot.

14. The cable release mechanism of claim 13 wherein the center of said plate chamfer is located in a horizontal plane above the axis of pivot of the pelican hook.

15. The cable release mechanism of claim 14 further comprising a clevis plate carried by the frame and a clevis opening provided in said clevis plate for mounting said clevis plate and said cable release mechanism to a secure structure.

16. In a cable release mechanism having a frame, a pelican hook pivotally mounted on the frame and a keeper ring provided in slidable cooperation with the frame and normally engaging the free end of the pelican hook to retain a towing cable against the pelican hook, the improvement in combination therewith comprising a fluid-operated cylinder carried by said frame; a piston cooperating with said cylinder in reciprocating relationship, said piston having one end extending from said cylinder, said one end of said piston engaging said keeper ring for selective disengagement of the keeper ring from the free end of the pelican hook responsive to fluid activation of said cylinder and release of the cable from the pelican hook; a clevis plate carried by the frame and a clevis opening provided in said clevis plate for mounting said clevis plate and said cable release mechanism to a secure structure; a cable plate fixedly attached to said clevis plate and a cable plate slot provided in said cable plate; a lanyard pin vertically carried by said keeper ring in slidably relationship; and a lanyard cable extending through said cable plate slot, said lanyard cable having one end removably engaging said frame, said lanyard cable further looped over said lanyard pin for manually slidably displacing said keeper ring from said free end of said pelican hook and releasing the towing cable responsive to tensioning of said lanyard cable.

17. The cable release mechanism of claim 16 further comprising a rod clevis having one end secured to said piston and a pair of clevis arms projecting from the opposite end of said rod clevis, with said lanyard pin extending through said clevis arms, for connecting said keeper ring to said piston.

18. The cable release mechanism of claim 16 further comprising a horizontal slot provided in the frame and wherein the keeper ring is further characterized by a pair of keeper plates, a top shim and a bottom shim rotatably carried by said keeper plates, said top shim normally provided in engagement with the free end of said pelican hook and said bottom shim provided in registration with said horizontal slot in said frame when said cable release mechanism is in functional configuration.

19. The cable release mechanism of claim 16 further comprising:

(a) a rod clevis having one end secured to said piston and a pair of clevis arms projecting from the opposite end of said rod clevis, with said lanyard pin extending through said clevis arms, for connecting said keeper ring to said piston; and (b) a horizontal slot provided in the frame and wherein the keeper ring is further characterized by a pair of keeper plates, a top shim and a bottom shim rotatably carried by said keeper plates, said top shim normally provided in engagement with the free end of said pelican hook and said bottom shim provided in registration with said horizontal slot in said frame base when said cable release mechanism is in functional configuration.

20. The cable release mechanism of claim 19 further comprising a pair of vertical slots provided in said keeper plates in spaced, facing relationship, respectively and wherein the ends of said lanyard pin are slidably disposed in said vertical slots.

21. The cable release mechanism of claim 20 further comprising a pair of side plates carried by said pelican hook and a plate chamfer provided in each of said side plates, for receiving and seating the towing cable against said pelican hook and wherein the center of said plate chamfer is located in a horizontal plane above the axis of pivot of the pelican hook.

22. In a cable release mechanism having a frame, a pelican hook pivotally mounted on the frame and a keeper ring provided in slidable cooperation with the frame and normally engaging the free end of the pelican hook to retain a towing cable against the pelican hook, the improvement in combination therewith comprising a fluid-operated cylinder carried by said frame; a piston cooperating with said cylinder in reciprocating relationship, said piston having one end extending from said cylinder, said one end of said piston engaging said keeper ring for selective disengagement of the keeper ring from the free end of the pelican hook responsive to fluid activation of said cylinder and release of the cable from the pelican hook; a clevis plate carried by the frame and a clevis opening provided in said clevis plate for mounting said clevis plate and said cable release mechanism to a secure structure; a cable plate fixedly attached to said clevis plate and a cable plate slot provided in said cable plate; a lanyard pin vertically slidably carried by said keeper ring; a lanyard cable extending through said cable plate slot, said lanyard cable extending around said lanyard pin and projecting back through said cable plate slot; and a clamp lead eye secured to one end of said lanyard cable for securing said lanyard cable in said cable plate slot and around said lanyard pin and manually slidably displacing said keeper ring from said free end of said pelican hook and releasing the towing cable responsive to tensioning of said lanyard cable.

* * * * *